US006478483B2

(12) United States Patent
Maruyama et al.

(10) Patent No.: US 6,478,483 B2
(45) Date of Patent: Nov. 12, 2002

(54) APPARATUS FOR PROCESSING PHOTOSENSITIVE MATERIAL

(75) Inventors: Toshihito Maruyama, Tokyo (JP); Shigeyoshi Suzuki, Tokyo (JP); Sadao Kuriu, Tokyo (JP); Yasuo Tsubai, Tokyo (JP); Shin Nakagawa, Tokyo (JP); Kunihiro Fukushima, Tokyo (JP); Masayoshi Otsuka, Tokyo (JP)

(73) Assignee: Mitsubishi Paper Mills Limited, Tokyo (JP)

( * ) Notice: Subject to any disclaimer, the term of this patent is extended or adjusted under 35 U.S.C. 154(b) by 0 days.

(21) Appl. No.: 09/738,980

(22) Filed: Dec. 19, 2000

(65) Prior Publication Data

US 2001/0004422 A1 Jun. 21, 2001

(30) Foreign Application Priority Data

| | | |
|---|---|---|
| Dec. 20, 1999 | (JP) | 11-361027 |
| Apr. 26, 2000 | (JP) | 2000-126396 |
| Apr. 28, 2000 | (JP) | 2000-128652 |
| Apr. 28, 2000 | (JP) | 2000-128653 |
| Nov. 13, 2000 | (JP) | 2000-344647 |

(51) Int. Cl.[7] ..... G03D 5/00
(52) U.S. Cl. ..... 396/604; 396/626; 396/627
(58) Field of Search ..... 396/604, 611, 396/627, 567–570, 626; 118/52, 54, 300, 319, 410

(56) References Cited

U.S. PATENT DOCUMENTS

| | | | | |
|---|---|---|---|---|
| 3,589,261 A | * | 6/1971 | Kirkelis | |
| 4,623,236 A | * | 11/1986 | Stella | 396/604 |
| 4,963,473 A | * | 10/1990 | Nakano et al. | 396/604 |
| 5,210,005 A | * | 5/1993 | Takekoshi et al. | 396/604 |
| 5,572,273 A | * | 11/1996 | Vackier et al. | 396/604 |
| 5,702,527 A | * | 12/1997 | Seaver et al. | 118/300 |
| 6,139,639 A | * | 10/2000 | Kitamura et al. | 118/410 |

* cited by examiner

*Primary Examiner*—D. Rutledge

(57) ABSTRACT

There are disclosed a processing apparatus for a photosensitive material having a coating device of a processing liquid to a photosensitive material, which comprises using a slot die having a manifold and a slot at the inside of the die as a coating device, and a processing apparatus for a photosensitive material which comprises a photosensitive material transferring device, a photosensitive material detecting device, a slot die for coating a processing liquid to the photosensitive material and having a manifold and a slot at the inside of the die, and a device for supplying a predetermined amount of the processing liquid to the slot die, wherein a detection result at the detecting device of the photosensitive material is fed back to the supplying device of the processing liquid to control operation of the processing liquid supplying device.

18 Claims, 10 Drawing Sheets

APPARATUS FOR PROCESSING PHOTOSENSITIVE MATERIAL

BACKGROUND OF THE INVENTION

1. Field of the Invention

This invention relates to an apparatus for processing a photosensitive material, particularly to a processing apparatus by coating a processing liquid to a photosensitive material whereby processing the photosensitive material.

2. Prior Art

Photosensitive materials, such as photosensitive films, photographic paper, lithographic printing plates and the like, on which images have been recorded are processed with a processing liquid such as developing solution (activator), fixing solution, neutralization and stabilizing solution (stabilizer), and rinsing water. Apparatuses for performing such processes upon photosensitive materials include a known dip-type processing apparatus wherein the photosensitive materials are fed into a processing tank storing a processing liquid by feeding means comprising pairs of feed rollers and the like and then dipped in the processing liquid, thereby subjected to processing.

In such a dip-type processing apparatus, the processing liquid is deactivated due to repeated processings for many photosensitive materials or developing degradation with time resulting from carbon dioxide and oxygen in the atmosphere. The processing liquid is recovered from the deactivation by adding a replenishing fluid to the processing liquid. This causes a difference between the ingredients of the processing liquid when the process starts and the ingredients of the processing liquid after a certain amount of processing continues, failing to achieve exactly uniform processing. Also, such a dip-type processing apparatus involves problems that it requires a great amount of processing liquid and must dispose a great amount of waste liquid whereby the running cost is high, and maintenance of the apparatus becomes difficult.

To solve such a problem, a coat-type photosensitive material processing apparatus has been used for coating a photosensitive surface of the photosensitive material with the processing liquid in amounts required to process the photosensitive material to perform processing in place of immersing the photosensitive material in the processing liquid as disclosed in Japanese Provisional Patent Publication No. 237455/1987. For example, in Japanese Provisional Patent Publication No. 237455/1987, as such a coat-type processing apparatus, there is disclosed a processing apparatus in which a processing liquid is discharged from a processing liquid feeding nozzle having a plural number of processing liquid-discharging holes to a roller the surface of which is roughened by, for example, forming slender holes on the surface thereof (hereinafter called to as "surface roughened roller"), and the surface roughened roller is rotated in tough with the photosensitive material to coat the processing liquid.

However, in the processing apparatus disclosed in Japanese Provisional Patent Publication No. 237455/1987, there is a problem that a photosensitive film of the photosensitive material is injured. Also, it is preferred to minimize an amount of the processing liquid in view of the running cost or environmental problem, etc., but in the above-mentioned processing apparatus, if the amount of the processing liquid fed to a processing liquid feeding nozzle is made a little amount, it is difficult to make a feed amount of the processing liquid uniform so that there is a problem that an amount of the processing liquid becomes ununiform.

To solve the above problems, a processing apparatus having a processing liquid supplying portion at upper portion, a bottom end thereof is a slit-shaped opening, and a processing liquid is coated through the opening portion is disclosed in, for example, U.S. Pat. No. 5,398,092, Japanese Utility Model Publication No. 8956/1994, and Japanese Provisional Patent Publication No. 27677/1994. The desired object can be principally accomplished by the processing apparatus, but there are problems in properties and safety as a coating apparatus. That is, there are principle problems that the feed port and the slit are directly connected so that the processing liquid is difficultly spread uniformly over the whole width of the coating apparatus, and a stable meniscus can be hardly formed since the top end of the slit is in tough with the surface of the photosensitive material. According to the above, there are also problems that coated amounts to the coating width direction and the flow direction of the photosensitive material become ununiform, and, in coated surface quality, longitudinal streak-shaped unevenness or liquid cracking (the so-called rivulet on coating technology) is likely caused.

SUMMARY OF THE INVENTION

Accordingly, an object of the present invention is to provide a processing apparatus which can process uniformly and stable over the whole surface of a photosensitive material with a little amount of the processing liquid. Another object of the present invention is to provide a processing apparatus in which an amount of a waste liquid becomes an extremely little or none.

The above objects of the present invention can be basically accomplished by a processing apparatus of a photosensitive material having a coating means of a processing liquid to a photosensitive material, which comprises a slot applicator having a manifold and a slot at the inside of the applicator being used as the coating means.

DESCRIPTION OF THE PREFERRED EMBODIMENTS

The present invention will be described more specifically based on the attached drawings, but the present invention is not limited by the embodiments mentioned in these drawings.

Figure 1:
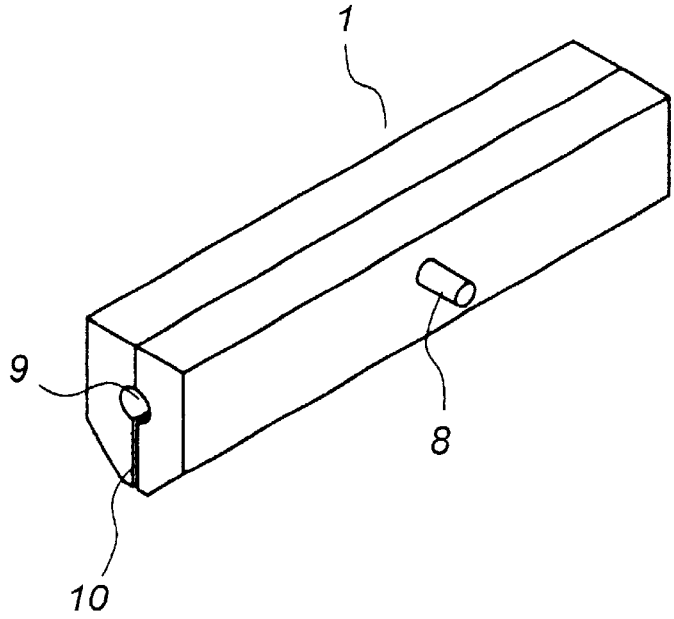
FIG. 1 is a perspective view of an example of the slot applicator to be used in the present invention.

FIG. 1 is a perspective view of a slot applicator to be used in the present invention.

Figure 2:
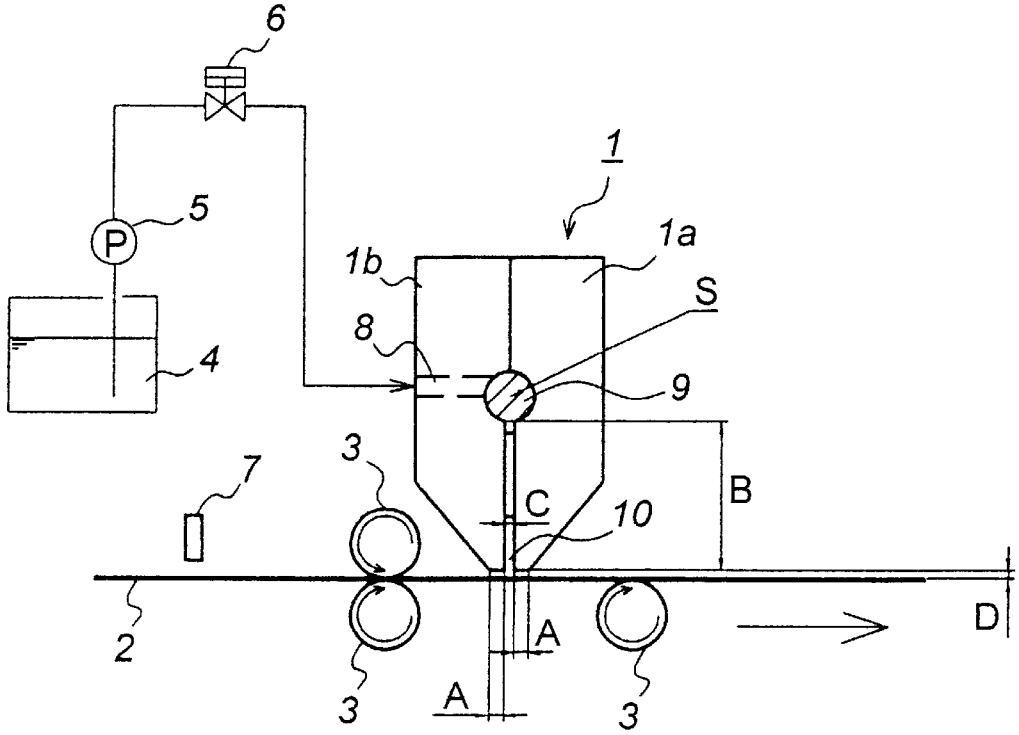
FIG. 2 is a schematic sectional view of a processing liquid-coating portion using the slot applicator of the present invention.

FIG. 2 is a schematic sectional view of a processing liquid-coating portion in the processing apparatus of the present invention.

The reference numeral 1 is a slot applicator and constituted by 1*a* and 1*b* but it may be integrally constituted. A material of the slot applicator is not specifically limited and may be any material so long as it satisfies corrosion resistance to the processing liquid and mechanical accuracy, and is preferably stainless steel. In addition, those in which a general structural steel is subjected to chromium plating or plastics may be used. Incidentally, when it is prepared by metal, an annealing treatment may be previously carried out to exclude stress strain at the time of machining.

A structure of the slot applicator 1 is explained. The reference numeral 8 is a processing liquid feeding port and is connected to a manifold 9. Here, the sectional surface area of the manifold 9 is represented by S. The manifold 9 is to broaden the processing liquid flown thereinto to a width direction and is not provided in the processing apparatus disclosed in the above-mentioned U.S. Pat. No. 5,398,092, Japanese Utility Model Publication No. 8956/1994, and Japanese Provisional Patent Publication No. 27677/1994. After the processing liquid is once filled to the width direction of the manifold 9, an action of feeding into a slot 10 is carried out so that a flow amount from the slot 10 can be uniformized to the width direction. A processing liquid feeding port 8 may be generally provided at the center of the width direction of the slot applicator with one portion, but may be provided at a plural number of the portions at the width direction of the slot applicator. A sectional shape (a shape represented by the sectional surface area S) of the manifold 9 is a circular shape in FIG. 1, but the present invention is not limited by it and may be any shape. For example, it may be either of a semi-circular shape, an elliptical shape, or a rectangular shape. Also, the sectional surface area S may be constant to the width direction of the slot applicator or the sectional surface area may be reduced toward the right and left end portions with a feeding port 8 as a center (when it is provided substantially at the center portion of the width direction). C in FIG. 2 represents a gap distance of the slot through which a processing liquid is flow out, and B represents a length of the slot.

Both end portions to the width direction for coating of the manifold 9 and the slot 10 of the slot applicator 1 are sealed by inserting a spacer, etc. so as to not flow the processing liquid which is not shown in FIGS. 1 and 2 for convenience' sake.

In the present invention, the sectional surface area S of the manifold 9 is preferably 100 $mm^2$ or less, particularly preferably 80 $mm^2$ or less. The lower limit is not specifically limited and is acceptable when the maximum thickness of the manifold 9 is thicker than the gap distance C of the slot. For example, the lower limit of the sectional surface area S is suitably about 5 to 10 $mm^2$. When the sectional surface area S changes over the width direction, a preferred range of the above-mentioned sectional surface area S represents the maximum value. By setting the sectional surface area S within the above-mentioned range, a flow amount to the width direction of the coating can be uniformized.

Moreover, the present inventors have earnestly studied about optimum conditions of a viscosity of the processing liquid and the slot applicator and found out the following. That is, when the gap distance C of the slot is 0.5 mm or shorter and the viscosity of the processing liquid is made $\mu$ (centipoise), the length B (mm) of the slot is preferably a length satisfying the following equation 1:

$$B > 50 \times C/\mu^{0.3} \quad (1)$$

In the present invention, the gap distance C of the slot is preferably about 0.3 mm or less, more preferably in the range of about 0.05 to about 0.2 mm.

The symbol A in FIG. 2 is a length of a lip land of the slot applicator, and the length A is preferably in the range of about 0.1 to about 5 mm. Incidentally, the length A of the lip land is not necessarily an equal length at the upstream side and the down stream side of the slot.

In FIG. 2, the photosensitive material 2 is conveyed from left side of the drawing to the right direction by a driving device which is not shown. The top end portion of the photosensitive material during conveying is detected by a detector 7, and a pump 5 is driven by a signal from the detector 7 to open a valve 6 whereby a processing liquid 4 is fed to a slot applicator 1. Then, the terminal portion of the photosensitive material is also detected by the detector 7 to send a signal to stop the pump 5 and the valve 6 is closed. This is the basic control flow of the apparatus shown in FIG. 2. Here, the valve 6 is not necessarily required. For example, by calculating a conveying rate of the photosensitive material 2 and a distance from the detector 7 to the slot of the slot applicator 1 (an arithmetic and control unit is not shown), a timing of driving/stopping the pump 5 is optionally controlled so that a loss of the processing liquid 4 can be substantially avoided.

The above-mentioned pump 5 is generally used as a processing liquid feeding means for feeding the processing liquid to the slot applicator 1. The pump to be used in the present invention is not specifically limited, and a pump in which a rotation number (in the case of a gear pump) or a number of strokes (in the case of a vibration type pump such as a diaphragm pump, etc.) can be structurally variable, i.e., a metering pump is preferred. Also, to coat the processing liquid uniformly, a pump which is less ununiform in a flow amount (i.e., the so-called pulsation), is preferred. If necessary, a pulsation preventive device in an air damper system may be provided during the piping after the pump. Also, a piston type pump is preferably used.

Figure 3:
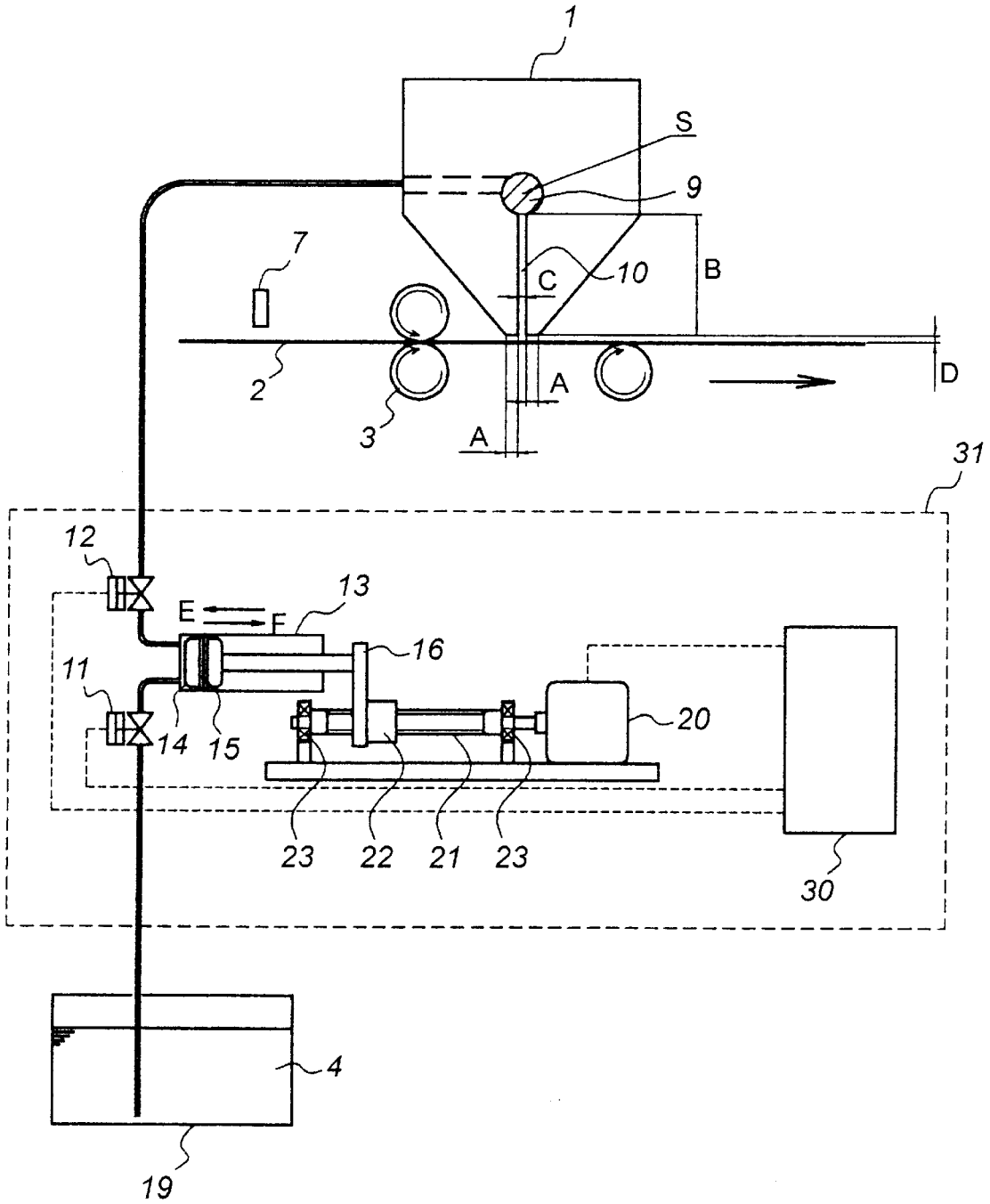
FIG. 3 is a schematic sectional view of a processing liquid-coating portion using a piston type pump.

A schematic sectional view of a processing apparatus using a piston type pump is used is shown in FIG. 3. The piston type pump is constituted by a cylinder 13 and a piston 14. A sealing member 15 is preferably provided to the piston 14 to ensure sealing of the processing liquid, and, for example, a commercially available O-ring may be preferably used.

A means for carrying out reciprocating motion of the piston 14 is not specifically limited, and in FIG. 3, a system using a motor 20 and ball screws (21 and 22) is shown as an example. The reference numeral 21 shows a male screw of the ball screw and 22 shows a female screw of the same. The above-mentioned male screw 21 is rotated by the motor 20, whereby the above-mentioned female screw 22 moves right and left of the drawing. At the above-mentioned female screw 22, a connecting member 16 which links to the piston 14 so that the movement of the female screw 22 is transferred to the piston 14 as such, and the piston 14 moves like an arrow E or F in the drawing in accordance with the normal rotation and the reverse rotation of the motor 20. Incidentally, the reference numeral 23 shows a bearing which is to support the above-mentioned male screw 21 and to smoothly rotate the same.

For processing a photosensitive material, it is preferred to have a certain degree of tolerance in a processing rate (in other words, a coating rate) or a coating amount per unit area of the processing liquid in many cases, so that it is desirable that the motor 20 in FIG. 3 is variable in rotation number to variously select the flow amounts of the processing liquid to be discharged from a cylinder 13. For example, a motor of using a servomechanism, due to an inverter, due to a stepping motor, etc. can be used. Also, if necessary, a reduction unit using a gear, etc., may be interposed.

In the following, processing operations of a photosensitive material is explained in detail. A motor 20, a suction valve 11 and a discharge valve 12 mentioned hereinbelow are connected to a control unit 30. The position of the piston 14 shown in FIG. 3 is a position of starting the processing (hereinafter referred to as "origin position"). First, the suction valve 11 is made open and the discharge valve 12 close, and the motor 20 is driven to move the piston 14 to the direction of the arrow F. A rotation rate of the motor 20 at this time is not specifically limited. According to this procedure, the processing liquid 4 is filled in the cylinder 13. Incidentally, as a method of stopping the piston 14 by moving at a desired position, it can be considered various methods. For example, a method of rotating a ball screw with a predetermined number of times by utilizing the fact that a moving distance per one rotation of the ball screw has been known, a method of detecting the position of the piston 14 with a sensor not shown in the drawing and controlling the motor 20 with a signal from the sensor, or the like may be used. Either of the methods can be easily realized by the function in the control unit 30. As the control unit 30, for example, a commercially available sequencer may be used. An amount of the processing liquid to be filled in the cylinder 13 is at least not less than the amount of the processing liquid necessary for processing one sheet of the photosensitive material.

Next, a timing of feeding the processing liquid is determined in the control unit 30 based on the signal of which the top end of the photosensitive material 2 to be conveyed with a constant rate detected by the detector 7. Said timing of feeding can be obtained, for example, by making a time at which the above-mentioned signal is obtained a starting point, and making a time obtained by dividing the conveying rate of the photosensitive material 2 by the distance from the detector 7 to the top end portion of the slot applicator 1 a setting value of a timer in the control unit 30. Incidentally, the setting value of the above-mentioned timer may be optionally corrected depending on the situation of coating by the slot applicator 1.

As the time of reaching the timing of feeding as mentioned above, the suction value 11 is opened and the discharge valve 12 is closed, and the motor 20 is driven to move the piston 14 to the direction of the arrow E in the drawing. According to this operation, the processing liquid 4 is fed to the slot applicator 1. The moving rate of the piston 14 to the direction E can be determined by a desired wet coating amount of the processing liquid 4, the conveying rate and the processing width of the photosensitive material 2, and an inner diameter of the cylinder 13. A rotation number of the motor 20 which is the above-mentioned moving rate can be calculated from the screw pitch of the ball screw 21. Calculations of the above-mentioned moving rate and the rotation number of the motor can be easily realized by the function of the control unit 30. It is desirable that the motor 20 has sufficient rotation accuracy and rotation torque since fluctuation of a flow amount for discharging the processing liquid 4 causes coating unevenness of the processing liquid on the photosensitive material, and the sealing member 15 provided at the piston 14 slides at an inner wall of the cylinder 13 with a constant frictional resistance.

A timing for stopping the motor 20, i.e., a timing of passing the terminal end of the photosensitive material 2 through the top end portion of the slot applicator is determined based on the signal of which the detector 7 detected the terminal end of the photosensitive material 2, so that the motor 20 is stopped at said timing for stopping. Said timing for stopping can be determined by the same manner as that of the above-mentioned liquid feeding timing. After stopping the motor 20, the suction valve 11 is turned to the open side and the discharge valve to the close side, and then, the piston 14 is moved to the direction E to return the processing liquid in the cylinder 13 to a processing liquid tank 19. The piston 14 is stopped at the origin position as mentioned above. According to this procedure, a series of operation with regard to coating to one sheet of the photosensitive material is completed.

Next, the suction valve 11 is turned to the close side and the discharge valve 12 to the open side so that the piston 14 is moved to the direction F to suck the processing liquid 4 staying at a slot 10 whereby the processing liquid 4 is returned to the feeding side of said processing liquid, i e., in FIG. 3, into the cylinder 13 of the processing liquid feeding device 31. By adding this step, a state in which the processing liquid is attached to the top end portion of the slot applicator after completion of coating can be avoided. If the processing apparatus is stopped for a long period of time with the state that the processing liquid is attached to the top end portion of the slot applicator, there is a case where the above-mentioned processing liquid is solidified and adhered to cause a trouble when starting the next processing.

The timing of sucking the processing liquid to the feeding side may be either after completion of the (coating) processing of the respective photosensitive materials per every sheet or after completion of the processing of the photosensitive materials with a desired number of sheets. In the former case, after sucking the processing liquid 4 in the slot 10 with a predetermined amount at the feeding side, the suction valve 11 is turned to the open side and the discharge valve 12 to the close side, and the next operation of sucking the processing liquid for processing the photosensitive material is continuously carried out. Incidentally, when the above-mentioned valves operation is carried out, the motor 20 may be once stopped depending on necessity. Also, when the processing liquid 4 at the slot 10 is sucked to the feeding side at the time of completing the processing of the photosensitive materials with a desired number of sheets, said sucking operation can be carried out, for example, by a timing of pressing down a push button switch (not shown in the drawing).

The above-mentioned sucking amount is not specifically limited, and it is preferably sucking the processing liquid within the range of 1 mm or longer from the outlet edge of the slot 10 and not reaching the manifold 9, more preferably 1 mm or longer to 10 mm or shorter from the outlet edge of the slot 10.

A moved distance of the piston 14 depending on the above-mentioned sucking amount can be controlled by the above-mentioned explanation about the operation of moving and stopping the piston 14 at a desired position. The moving rate of the piston 14 at this time is not specifically limited. An effective inner volume of the cylinder 13 (the maximum filling amount of the processing liquid 4) is required to be at least an amount of the processing liquid necessary for processing one sheet of the photosensitive material or more.

In this embodiment, an example of using a pump as a processing liquid feeding means is shown but, in the present invention, a system in which the processing liquid is positioned higher than the slot applicator and it is naturally dropped by head may be employed. In this case, no pump is required and feeding of the processing liquid can be realized only by open-close of a valve. Incidentally, in this case, a flow amount can be controlled by making the above-mentioned valve a metering system, or by previously adjusting an opening degree so that the flow amount becomes a desired value by providing a flow meter equipped with a needle valve. Even in the natural dropping system, loss of the processing liquid can be substantially avoided by carrying out an open-close timing of the valve due to the signal from the detector 7 of the photosensitive material in the same manner as in the above-mentioned pump system.

When an extremely high accuracy is required to control the coated amount of the processing liquid to the photosensitive material, a flow meter is provided in the course of the piping of the processing liquid and the amount of the processing liquid is controlled by the above-mentioned pump or the metering valve by feeding back the signal of said flow meter as a standard.

In this embodiment, an example of using a pump as a processing liquid feeding means is shown but, in the present invention, a system in which the processing liquid is positioned higher than the slot applicator and it is naturally dropped by head may be employed. In this case, no pump is required and feeding of the processing liquid can be realized only by open-close of a valve. Incidentally, in this case, a flow amount can be controlled by making the above-mentioned valve a metering system, or by previously adjusting an opening degree so that the flow amount becomes a desired value by providing a flow meter equipped with a needle valve. Even in the natural dropping system, loss of the processing liquid can be substantially avoided by carrying out an open-close timing of the valve due to the signal from the detector 7 of the photosensitive material in the same manner as in the above-mentioned pump system.

In this embodiment, conveying rollers 3 are made a nip type before the coating and a free support type after the coating, but the present invention is not limited to these. For example, the photosensitive material 2 may be backed up by providing a roller(s) at downward of the slot applicator 1 to further improve coating stability of the processing liquid. The roller(s) may be either driving or non-driving. A material of the roller(s) is not specifically limited, and those conventionally used in the conventional photosensitive processing apparatus may be used.

Incidentally, it is preferred that the rollers are so provided that the photosensitive material is conveyed substantially a level state in view of the coating stability of the processing liquid.

It is not shown in this embodiment of the drawing, a liquid receiving dish, etc., may be provided at downward of the slot applicator 1 in view of possibility of generating a minute amount of excess liquid at the time of coating the processing liquid and the excess liquid may be recovered.

The symbol D shown in FIG. 2 or FIG. 3 shows a gap between the top end of the slot applicator 1 and the photosensitive material 2. A size of this gap D can be optionally selected depending on the coating amount, viscosity or surface tension of the processing liquid, etc.

Figure 4:
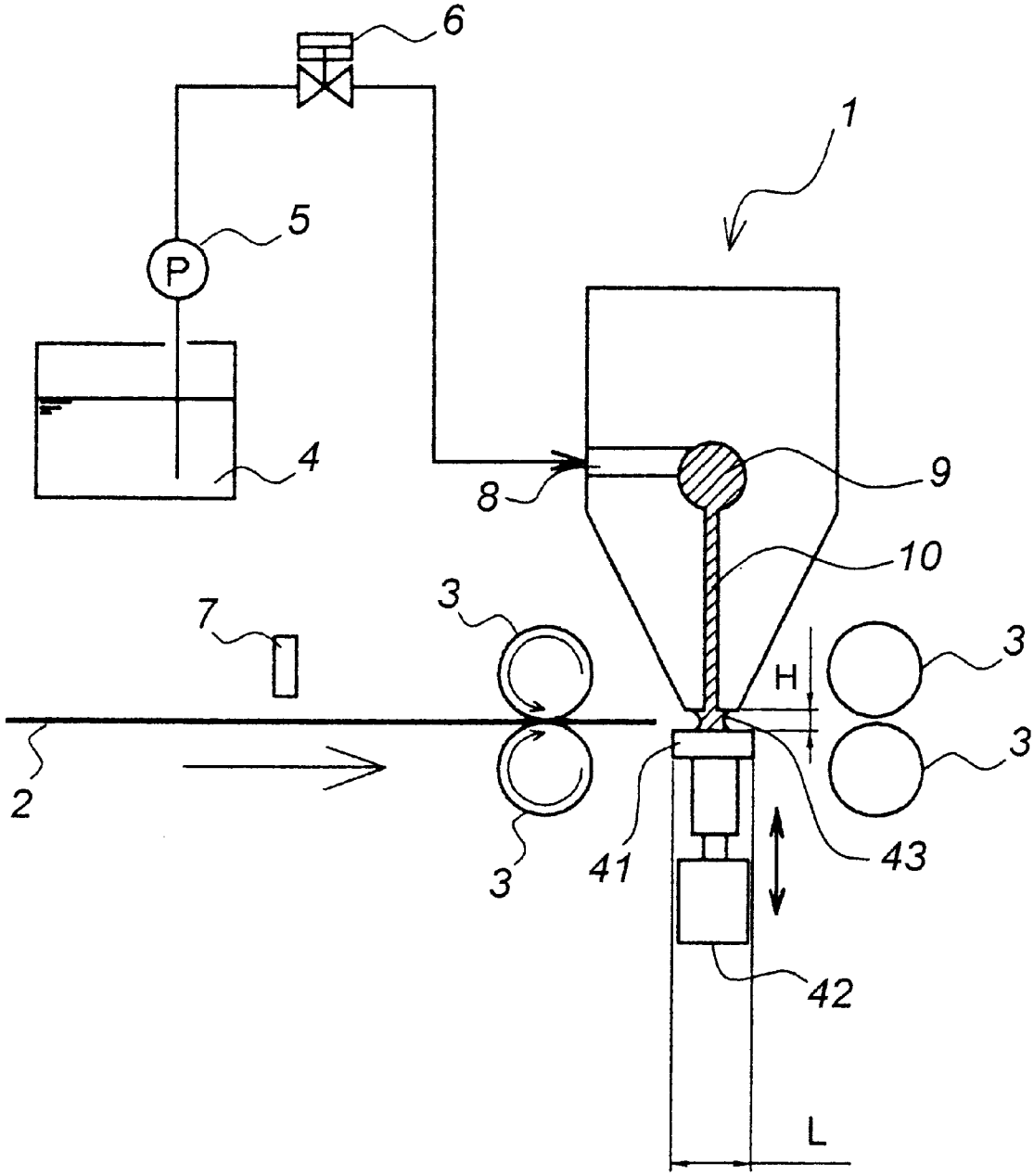
FIG. 4 is a schematic sectional view of a processing liquid-coating portion showing another embodiment of the present invention.

Next, other preferred embodiment of the present invention is explained by referring to FIG. 4. In this embodiment, it is preferred to provide a member 41 having a length substantially the same or longer than the coating width at the position opposed to the top end portion of the slot 10 of the slot applicator 1 with a distance within 3 mm from the top end portion of the same.

The above-mentioned member 41 is a material to form a processing liquid film 43 over the whole coating width with the top end portion of the slot 10. This processing liquid film 43 supports to effect uniform processing from the top end portion of the photosensitive material stably.

At the downward of the member 41, an up and down means 42 such as an elevator is provided. The up and down means 42 is to carry out the positioning of the member 41 to the up and down direction. When the up and down means 42 is provided for carrying out the present invention, it is possible, for example, to adapt to various gaps of the photosensitive materials or to realize the positioning of the member 41 at the optimum position in response to the coating conditions (a coating amount or a processing rate) of the processing liquid. Also, when the processing apparatus is suspended, leakage of the processing liquid can be prevented by contacting the member 41 to the top end portion of the slot 10 of the slot applicator 1. In FIG. 4, cylinder type actuator is exemplified but it is not limited thereto so long as it can carry out an up-and-down motion. Also, when the thickness of the photosensitive material to be processed is constant, the above-mentioned up and down means 42 is not necessarily required.

A length of the member 41 to the coating width direction is to be a coating width of the slot applicator 1 or longer. As the shape of the member, an optional rod shaped member or a flat plate may be used so long as it has a shape capable of forming the processing liquid film 43 between the top end portion of the slot 10 and the member 41. It is preferably a shape in which the processing liquid film 43 can be easily formed, and thus, the portion of the member 41 opposed to the top end portion of the slot 10 is preferably a flat surface. That is, a length L at the upper surface of the member 41 is preferably 1 mm or longer, more preferably 2 mm or longer and the upper limit is sufficient with a length of about 10 mm. Also, the upper surface of the member 41 is preferably a horizontal plane. A material of the member 41 is not particularly limited so long as it has corrosion resistance, and there may be used, for example, stainless steel, plastics, a fluoro type resin (such as Teflon, etc.).

A distance H between the member 41 and the top end portion of the slot 10 is preferably within about 3 mm, more preferably within about 2 mm, further preferably within about 1.5 mm to form a uniform processing liquid film 43 over the whole coating width with a little coating amount. The lower limit of the distance H is a distance in which the photosensitive surface of the photosensitive material 2 is not contacted with the slot 10. Also, the upper surface of the member 41, i.e., the surface onto which the processing liquid is contacted, is preferably positioned at the same level as or slightly downward than the bottom surface of the photosensitive material 2 to avoid collision with the photosensitive material.

The above-mentioned processing liquid film 43 is formed before the top end portion of the photosensitive material 2 is reached at the slot applicator 1. As a method of forming the processing liquid film 43, there may be mentioned, for example, a method in which a driving time of the pump 5 is controlled by a timer (not shown in the drawing) based on the signal detected by the detector 7 to pass the photosensitive material 2. The valve 6 is closed with the timing when the pump 5 is changed from a driving state to a stopping state, the processing liquid film 43 can be provided and maintained stably with a static state. Also, the pump 5 is driven immediately before the top end portion of the photosensitive material 2 is reached at the slot applicator 1, coating of the processing liquid to the photosensitive material 2 may be carried out subsequent to formation of the processing liquid film 43.

Also, at the time of starting coating, the method of forming the above-mentioned processing liquid film 43 is effective for eliminating the problems that a flow amount distribution of the coating width direction is not reached to a steady state and coating is unstable based on the fact that a flow amount is not reached to a setting value at the time of starting driving of the pump.

In the slot applicator to be used in the present invention, a thin piece member having the same thickness as the predetermined thickness of the slot is preferably inserted partially into inside of the slot of said slot applicator.

Figure 5:
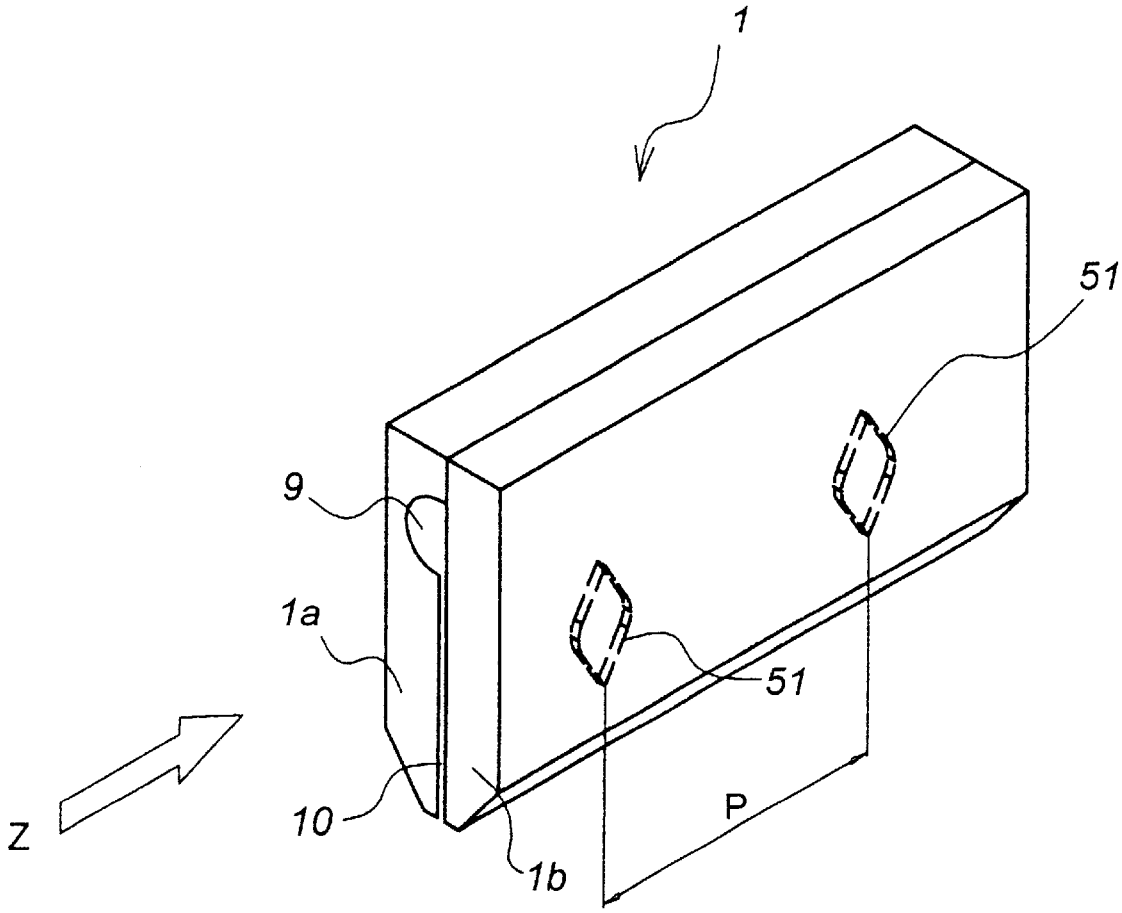
FIG. 5 is a partial perspective view showing another embodiment of a slot applicator to be used in the present invention.
Figure 6:
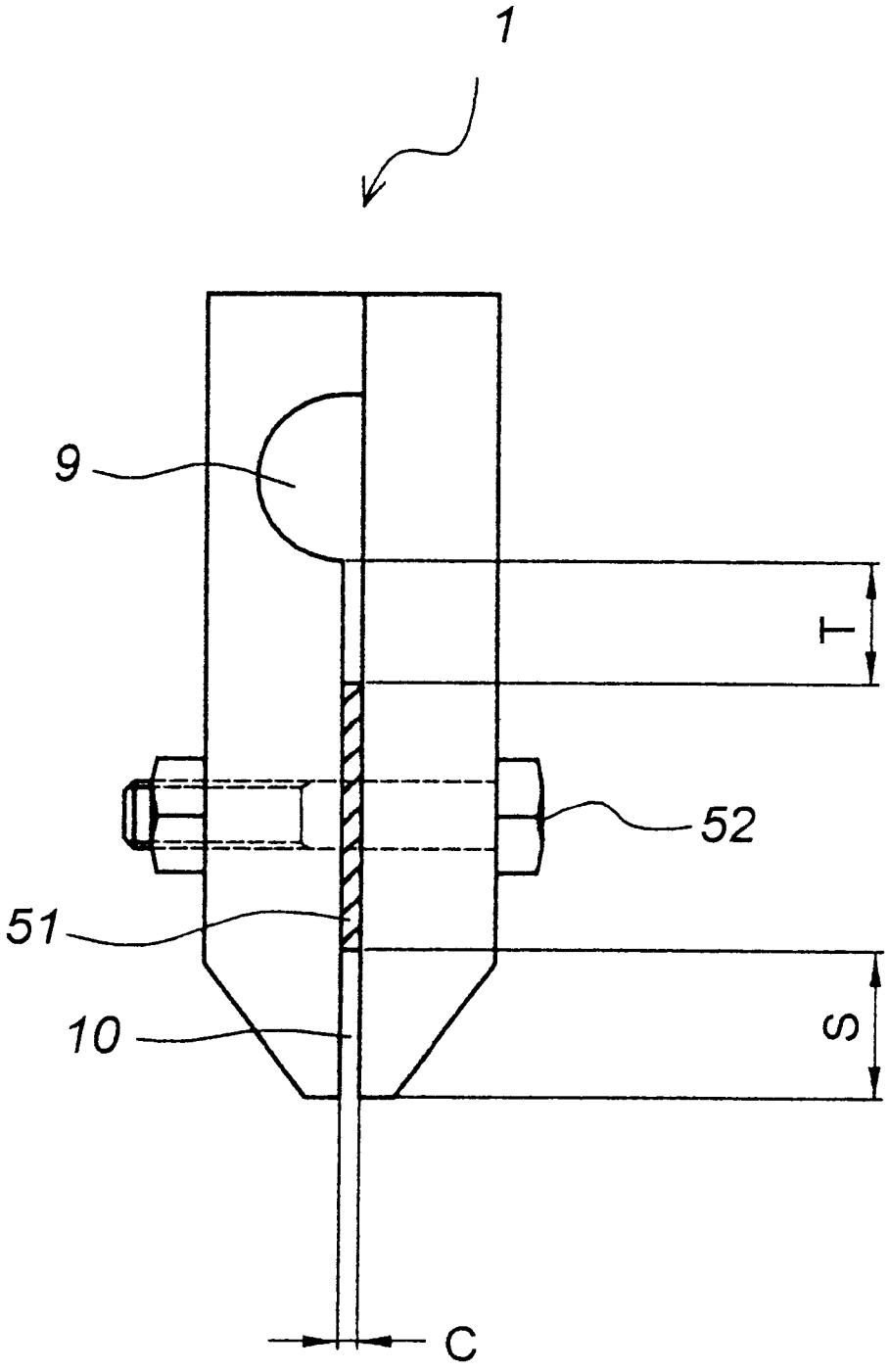
FIG. 6 is a side view from Z direction of FIG. 5.
Figure 7:
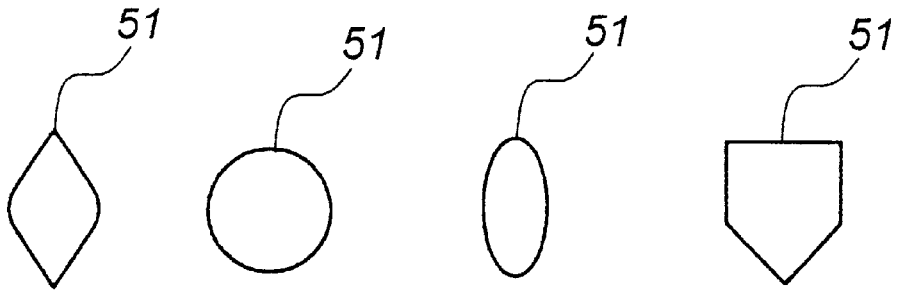
FIG. 7 is a plan view of a thin piece member to be inserted into the inside of the slot.

This embodiment is explained by referring to the drawings. FIG. 5 shows a partial perspective view of a slot applicator, FIG. 6 is a side view of FIG. 5 viewed from Z direction, and FIG. 7 shows an example of the thin piece member to be inserted into inside of the slot.

As shown in FIG. 5, the slot applicator 1 is constituted by the members 1*a* and 1*b*. The processing liquid is fed from a feeding port(s) (not shown in the drawing) perforated and provided at an optional position(s) of the manifold 9.

The reference numeral 51 is a thin piece member to be inserted into inside of the slot, and the thickness is the same as the gaps C of the slot.

The present inventors have found that even when a thin piece member 51 is inserted into inside of the slot 10, if there is a suitable space between the bottom portion of the thin piece member 51 and the outlet edge portion of the slot 10, no problem is generated for coating a processing liquid under the usual conditions including liquid properties of the processing liquid, coating amount thereof and processing rate (conveying rate of the photosensitive material). This provides a significant effect of remarkably reducing costs for manufacturing a slot applicator 1 as explained below.

The gaps C of the slot 10 is generally 0.5 mm or less, and depending on the liquid properties of the processing liquid or a coating amount, it is preferably 0.2 mm or less in some cases. As will be well known in the art, in the coating using a slot applicator, accuracy in thickness profile to the width direction of the slot is extremely important for uniform coating.

Accompany with spreading the width of the photosensitive material wider, a manufacturing cost of a slot applicator for processing (coating the processing liquid) becomes enormous to contain the thickness profile to the width direction of the above-mentioned slot within the desired range (for example, within±3%) in the conventional apparatus. When the case of stainless steel usually employed is mentioned as an example, a long term heat treatment which requires a high cost is essential to restrain deformation such as deflection, etc. due to strain at the time of machining. Also, in the general stainless steels (for example, SUS304 or SUS 316) described in JIS (Japanese Industrial Standard), strain cannot completely be removed even when heat treatment is carried out and the thickness profile cannot be within the desired range in many cases.

Thus, one cannot help selecting an expensive low-strain type material recommended by a manufacturer, which increases the cost. On the other hand, a certain strain-controlling effect can be obtained by the method in which a slot applicator is enlarged to make the shape with an aspect ratio of near to 1:1, but the resulting apparatus becomes heavy-weighted so that rigidity of a processing apparatus for a photosensitive material including a slot applicator is required and the whole apparatus is large sized whereby the cost becomes expensive.

According to the apparatus of the present invention, however, it is possible to use a general stainless steel without any heat treatment and any problem will occur even when the shape of the sectional surface of the slot applicator is a minimum size to be required. That is, even when deformation such as deflection, etc. is generated due to strain at the time of machining, this can be cancelled and the thickness profile to the width direction of the slot can be maintained within the desired range.

A number of the thin piece member 51 to be attached may be optionally selected depending on the length of the slot applicator 1 to the width direction or the degree of deflection of the material, and in the present invention, it is preferred to set two or more thin piece member 51 are attached. It is particularly effective when the length of the slot applicator 1 to the width direction is relatively long, for example, it is 500 mm or longer. In this case, an attachment pitch P of the thin piece member 51 is preferably within the range of 30 to 500 mm, more preferably 30 to 300 mm when the material of the slot applicator 1 is a general stainless steel. When three or more of the thin piece member 51 are attached, each pitch may be the same or different from each other. Also, it may be attached to the portion at which strain is particularly remarkable.

In the present invention, a number of the thin piece member 51 to be attached is preferably 2 or more, but an effect of the present invention can be also obtained when one of the thin piece member 51 is attached at the center portion to the width direction of the slot applicator 1. As shown in FIG. 5 and FIG. 6, the slot applicator 1 is generally constituted by two members 1*a* and 1*b*, and sealed by a spacer, etc. (whereas they are not shown in the drawing) to prevent flowing the processing liquid out of the manifold 9 at the both ends portion to the width direction and the slot 10. As the liquid sealing means, there may be mentioned the case where, for example, the above member 1*a* and/or 1*b* is/are integrally formed with the portions corresponding to the manifold 9 and the slot 10, or a member for liquid sealing (space filler) is separately inserted. In either case, the thickness of the liquid sealing means at the both side edge portion of the slot 10 is the same as the thickness of the thin piece member 51 as mentioned above, and also, the same as the gap of the slot 10 previously set. Accordingly, as mentioned above, adjustment of the thickness profile can be carried out in the present invention even when one thin piece member 51 is attached at the center portion to the width direction.

For assembling the slot die 1, it is preferred that the thin piece member 51 is inserted into inside of the slot 10 formed by assembling the members 1*a* and 1*b*, and fixed by tightening with a screw(s) or a bolt(s) 52 sandwiching the thin piece member 51 between the members 1*a* and 1*b* as shown in FIG. 6. In this case, it is necessary to previously perforate a hole through which the screw(s) or bolt(s) is/are penetrated to the thin piece member 51.

Thus, the thin piece member 51 has a role of a spacer in the slot 10, and as a result, uniformization of the thickness profile to the width direction can be accomplished. The resulting apparatus has a function as a processing apparatus for a photosensitive material sufficiently.

A material of the thin piece member 51 to be used in the present invention is not specifically limited so long as it has corrosion resistance to the processing liquid. For example, metals, plastics and rubbers such as rigid rubber may be used. It is particularly preferred to use a commercially available thickness gauge made of plastics, a PET (polyethylene terephthalate) film for industrial purpose, etc. The shape of the thin piece member 51 is preferably a shape in which it becomes thin at least downward, and may be exemplified by those as shown in FIG. 7.

Also, as in the film 104 shown in FIG. 10 mentioned hereinbelow, the thin piece member 51 to be inserted into the slot may have a shape integrally formed with the spacer which seals liquid flown out from the peripheral portion of the slot applicator.

The symbols S and T in FIG. 6 show a distance from the upper end of the thin piece member 51 to the manifold 9 and a distance from the bottom end of the same to the slot outlet, respectively. The distance T is not particularly limited in the present invention and may be zero (0). Also, the distance S can be optionally selected depending on the shape of the thin piece member 51, and generally 1 mm or more is preferred. Accordingly, the length of the thin piece member 51 to the longitudinal direction (the vertical direction) may be any value so long as the above-mentioned distances S and T are satisfied. The size of the lateral direction (the coating width direction of the thin piece member 51 may be a length sufficient for perforating a penetrating hole for a screw or a bolt as the minimum size, but it is preferred to be not so long than required.

In the processing apparatus of the present invention, a slot applicator which can be simply and easily prepared as explained below may be used. By using the slot applicator, a manufacturing cost of the processing apparatus can be markedly reduced. Also, when the gap distance C of the slot as mentioned above is thin (for example, 0.3 mm or less, further in the case of 0.2 mm or less), uniformity of the thickness profile to the coating width direction can be accomplished. The above embodiment will be explained in more detail by referring to FIGS. 8 to 11. This simple and easy slot applicator can be prepared by a simple method of piling up at least four members as mentioned below and fastening with a bolt, etc. to fix these. That is, the slot applicator comprises a plane plate 101 in which a slender hole 105 for forming a manifold is cut off, a plane plate 102 and a plane plate 103 which are sandwiching said plane plate 101 from both sides to fix, and a film 104 for forming a slot and inserted into either between the plane plate 101 and the plane plate 102 or the former and the plane plate 103, which are piled up and fixed by a fixing means such as a screw or a bolt, etc. In this embodiment of the present invention, the film 104 is inserted into the position between the plane plate 101 and the plane plate 103.

Figure 8:
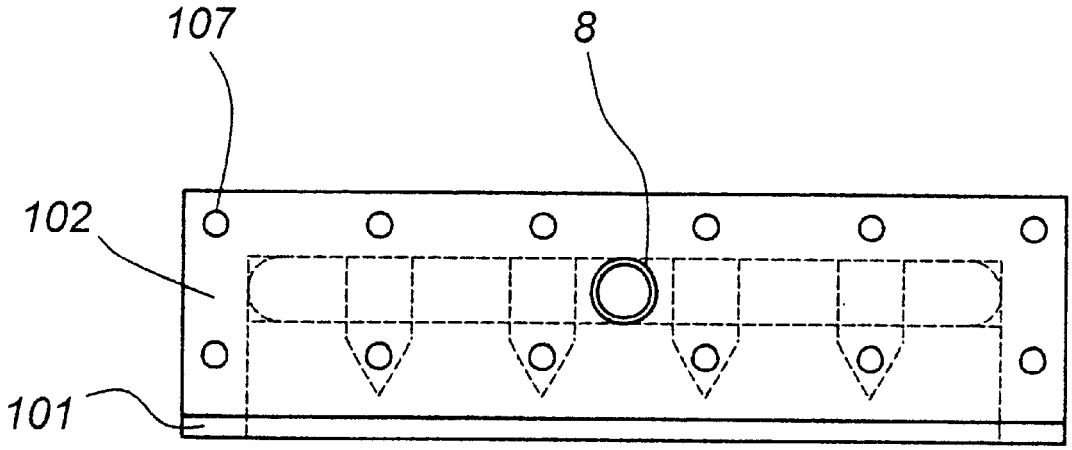
FIG. 8 is a front view of a slot applicator which can be easily and simply prepared to be used in the present invention.
Figure 9:
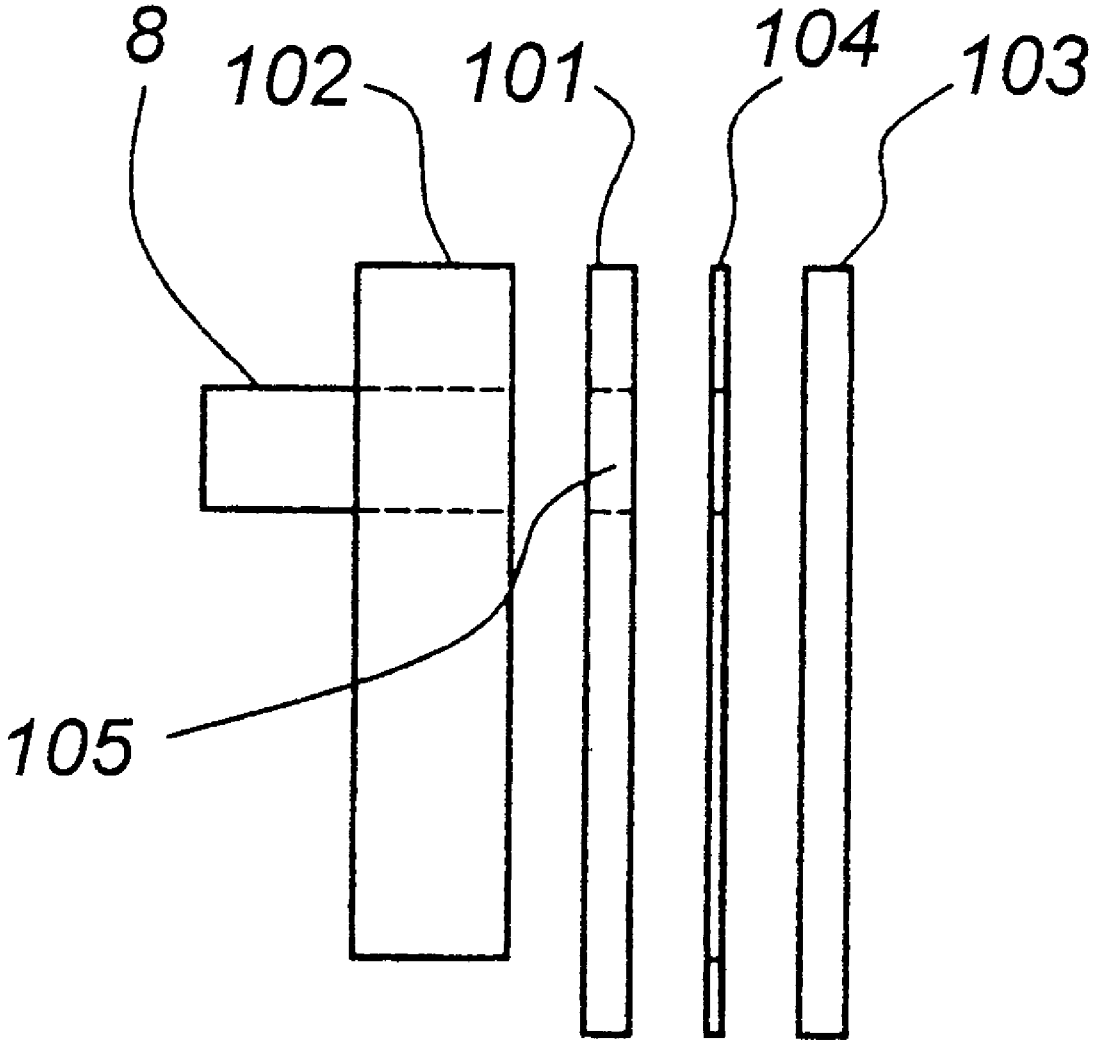
FIG. 9 is a side view of constitutional members of the slot applicator shown in FIG. 8.
Figure 10:
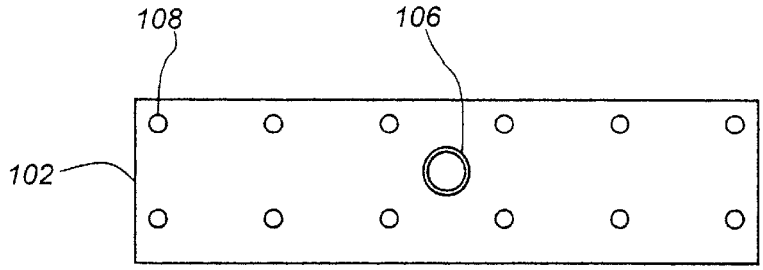
FIG. 10 is a plan view of constitutional members of the slot applicator shown in FIG. 8.
Figure 10:
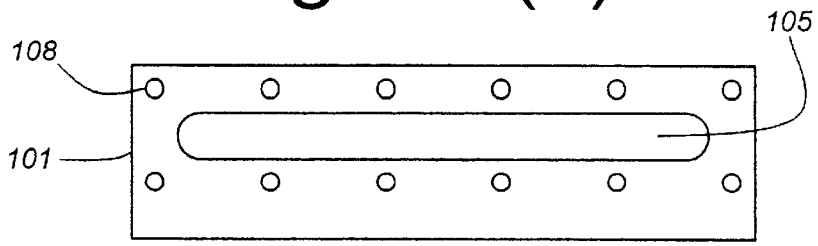
Figure 10:
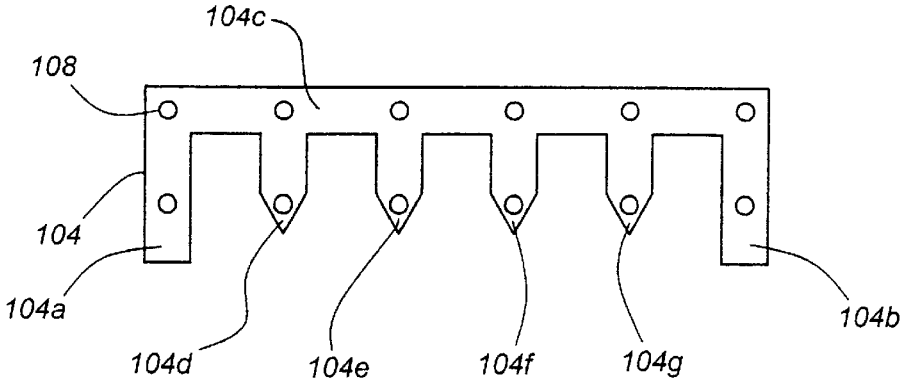
Figure 10:
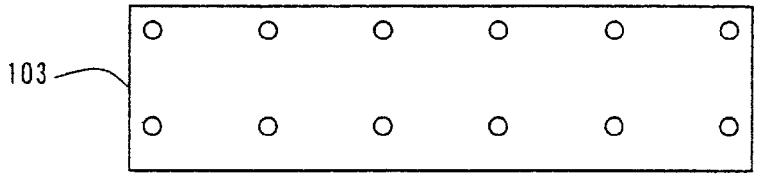
Figure 11:
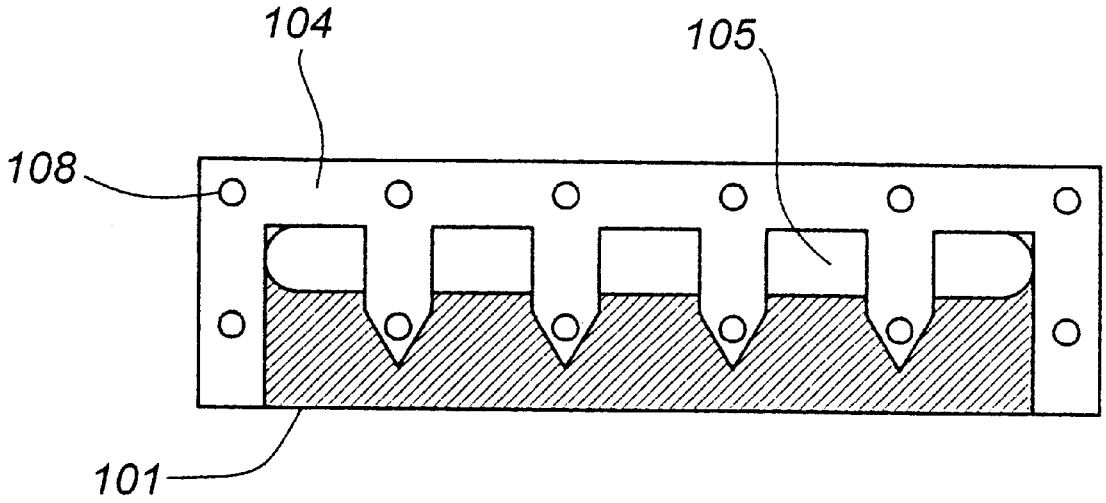
FIG. 11 is a plan view when a film 104 is laminated onto a plane plate 101 of the slot applicator shown in FIG. 8.

FIG. 8 is a front view of the slot applicator, FIG. 9 is a side view thereof dismounted to the respective constitutional members, FIG. 10 is a plan view of the respective constitutional members. In FIG. 8, dotted line portions show the structure where the inside of the slot applicator is seeing through, and correspond to a slender hole 105 and a film 104 shown in FIG. 11. At the plane plate 101, the slender hole 105 as shown in FIG. 11 is cut off to form a manifold. At the plane plate 102, a processing liquid feeding port 8 is provided. This processing liquid feeding port 8 may be provided two or more. At the respective constitutional member, holes 108 shown in FIG. 11 for inserting screws or bolts 107 are provided. This simple and easy slot applicator is basically constituted by the above-mentioned four members. However, depending on the materials of these members, for example, when stainless steel is employed for the plane plates 101 and 102 as mentioned below, a thin plastic resin film may be inserted between these plane plates 101 and 102 to prevent leakage of a liquid therebetween.

As shown in FIG. 9, it is preferred to make the length of the bottom end portions of the plane plates 101 and 103 the same and that of the plane plate 102 shorter than the above. This is because a liquid film is formed between the top end of the slot and the photosensitive material when the liquid flown from the slot is coated to the photosensitive material, and when the surface area at the tope end portion of the slot becomes large, there is a possibility of causing some trouble for formation of the liquid film. Thus, the length of the plane plate 102 is preferably shortened than those of the plane plates 101 and 103. The length of the film 104 at the bottom end portion is also preferably the same length as those of the plane plates 101 and 103 but a length thereof slightly longer or slightly shorter than the same is also acceptable.

The film 104 to be inserted between the plane plates 101 and 103 is to form a slot connected to the manifold between the plane plates 101 and 103, and a film having the same thickness as the previously set gap distance of the slot (which is the same meaning as the gap distance C of the slot as mentioned above) can be used. As a material of the film, a plastic film such as polyethylene terephthalate is preferred and the thickness thereof is preferably about 50 to about 300 $\mu$m. The shape of the film 104 is not particularly limited so long as it can form a slot at the bottom portion of the manifold (slender hole 105), but the shape as shown in FIG. 10(*c*) is preferred. That is, it is one sheet of a film comprising the both side edge portions 104*a* and 104*b*, and an upper end portion 104*c*, and a plural number of flaps 104*d* to 104*g* are integrally provided (In FIG. 10(*c*), a number of the flaps is made four for the convenience sake, but the number thereof is not limited by this embodiment). Said flaps have lengths positioned at the inside of the slot. This flap has the same role as the thin piece member 51 to be inserted into the slot and is important to make the gap profile of the slot uniform.

FIG. 11 shows a plane view when the above-mentioned film 104 is piled up on the plane plate 101. At the plane plate 101, the slender hole 105 for forming a manifold is cut off, and piled up so that the both side edge portions 104*a* and 104*b*, and an upper end portion 104*c* do not cover the slender hole 105 (provided that, in the present invention, the film 104 may cover part of the slender hole 105 with the extent that it does not inhibit the function of the manifold). Moreover, by further piling up the plane plate 103 thereon, a slot shown by the slanted lines is formed. This slot is connected to the manifold (slender hole 105). The processing liquid fed into the manifold and distributed into the width direction is, by passing through the slot, coated to the photosensitive material with a more uniform flow amount to the width direction.

This simple and easy slot applicator forms a slot by an extremely simple combination that the film 104 is interposed between the plane plates 101 and 103. When the coating width (a length of the slot applicator to the width direction) becomes long, it is difficult to maintain uniformity in the gap of the slot to the width direction of the coating (the gap profile of the slot becomes ununiform). This ununiform in the gap width of the slot can be canceled by a simple means of positioning the flaps 104*d* to 104*g* integrally provided to the film 104 with a suitable distance. This flap once stops partially the flow of the processing liquid from the manifold to the slot, but at the top end portion (the portion at which the liquid flows out) of the slot, it is necessary to cause a uniform flow to the width direction. Thus, the shape of the flaps is preferably made a shape in which the top end (bottom portion) becomes thin. The shape of the flaps is, for example, a triangle shape, a mountain shape, a semicircular shape, etc. Also, the position of the top end portion (bottom end portion) of the flap is required to be inside (upper portion) than the top end portion of the slot. The distance of the top end portion of the flap and the top end portion of the slot may vary depending on the shape of the top end portion of the flap, and preferably 1 mm or longer, more preferably 2 mm or longer.

The number of the flaps may be optionally selected depending on the coating width, and preferably provided with a distance of about 30 mm to about 200 mm, more preferably about 30 mm to about 100 mm. The width of the flap is preferably a size through which a hole for penetrating a screw or a bolt for fixing can be provided, more preferably about 5 to about 20 mm, and too large size than required is not preferred.

A material of the plane plates 101, 102 and 103 may be a plastic resin such as acryl, polycarbonate, vinylidene chloride, etc., or stainless steel, and stainless steel is preferably used. The thickness of the plane plate 101 influences the size of the manifold to be formed by the cut off slender hole 105. The preferred range of the sectional surface area S of the manifold is as mentioned above. Accordingly, the thickness of the plane plate 101 is suitably about 2 to about 5 mm. Also, a slot is formed by the plane plates 101 and 103, the surfaces which form the slot are required to be smoothly polished. Thus, it is economically advantageous to use a commercially available stainless plate which had previously been machined. In view of this point, as the materials for the plane plates 101 and 103, for example, cold rolling stainless steel which had been machined is preferably used. As the plane plate 102, a relatively thick stainless steel is used for control deflection when thin stainless steel is used as the plane plates 101 and 103 as mentioned above. The thickness of the plane plate 102 is suitably about 5 to about 15 mm.

As for the size of the slender hole 105 cut off from the plane plate 101 for forming the manifold, the sectional surface area thereof is according to the sectional surface area S explained in FIG. 2 as mentioned above. Accordingly, a length to the vertical direction of the slender hole 105 is suitable about 5 to about 20 mm. Also, a length to the width direction of the slender hole 105 can be optionally set depending on the coating width, and preferably substantially the same as or slightly longer than the coating width. In general, the coating width and the length to the width direction of the slot can be designed substantially the same length. However, the above-mentioned length to the width direction of the slender hole 105 may be shorter than the coating width so long as it is a sufficient length for uniformly spreading the liquid to be dropped in the slot to the width direction.

In this simple and easy slot applicator, the size (a sectional surface area as mentioned above) of the manifold to the coating width direction may be either substantially the same as shown in FIG. 10(*b*) or may be a shape in which the opening becomes gradually thin to the right and left directions with the feeding port as a center (when it is provided at substantially the center of the width direction). However, in the point of capable of easily processing of the slender hole 105, it is preferred to make substantially the same size to the coating width direction as shown in FIG. 10(*b*).

The processing apparatus of the present invention can be suitably used when the viscosity of the processing liquid is 10 cP or lower. Also, it is suitable when a coating amount of the processing liquid per $m^2$ of the photosensitive material is 100 ml or less. As the photosensitive material to be applied to the processing apparatus of the present invention, there may be mentioned a light-sensitive silver halide photographic material, a light-sensitive lithographic printing plate utilizing a silver complex diffusion transfer process, a light-sensitive lithographic printing plate using a photopolymer containing no silver salt, and the like. As the processing liquids of these photosensitive materials, there may be mentioned a developing solution, a fixing solution, a neutralizing solution, a washing solution, a finishing solution, etc.

Of these, the processing apparatus of the present invention is suitable for processing of a light-sensitive lithographic printing plate, particularly suitable for processing of a light-sensitive lithographic printing plate utilizing a silver complex diffusion transfer process. In particular, it is preferred to use the slot applicator of the present invention for coating a developing solution.

With regard to the light-sensitive lithographic printing plate utilizing a silver complex diffusion transfer process, U.S. Pat. Nos. 4,567,131 and 5,427,889, Japanese Provisional Patent Publications No. 116151/1991 and No. 282295/1992 can be referred to. This light-sensitive lithographic printing plate is constituted by an aluminum support, and at least a physical development nuclei layer and a silver halide emulsion layer provided thereon. General processing methods of the aluminum lithographic printing plate comprise the steps of development, washing (wash off: removal of a silver halide emulsion layer), finishing and drying.

In more detail, a metal silver image portion is formed on a physical development nuclei layer by developing treatment, and the silver halide emulsion layer is removed in the next washing treatment to expose a metal silver image portion (hereinafter referred to as "silver image portion") on the aluminum support. Simultaneously, anodized aluminum surface itself is exposed as a non-image portion. Next, for protecting the plate surface, a finishing liquid (which is also called to as a fixing solution or a finishing solution) is applied to.

Figure 12:
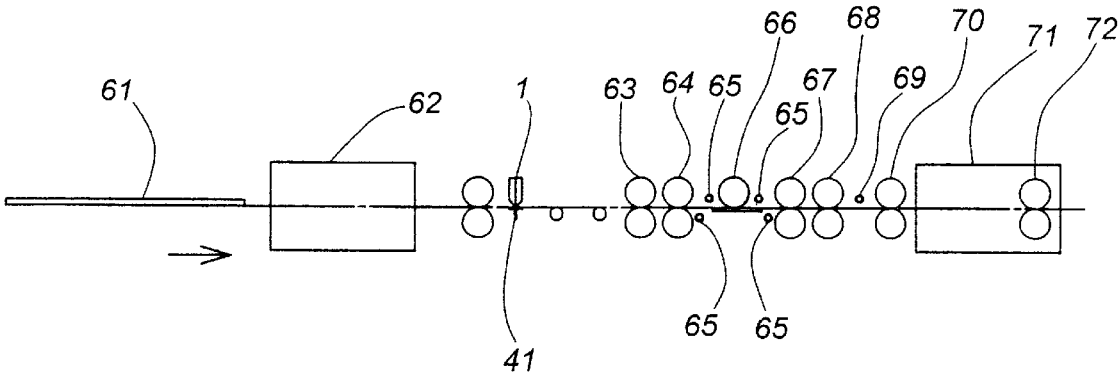
FIG. 12 is a schematic sectional view showing one example of the processing apparatus of an aluminum lithographic printing plate.

Next, as an example of the processing apparatus using the slot applicator of the present invention, the processing apparatus of the above-mentioned aluminum lithographic printing plate is explained. FIG. 12 is a schematic sectional view showing one embodiment. A lithographic printing plate 61 is conveyed to the direction of an arrow and processed. The lithographic printing plate 61 is heated by a heating device 62, a predetermined amount (for example, about 20 to about 100 ml per $m^2$ of the lithographic printing plate) of the developing solution is coated by a slot applicator 1 to carry out the developing treatment. A developing treatment time can be controlled by the distance from the slot die 1 to a pair of squeeze rollers 63 and a conveying rate. For example, the development time is set about 5 to about 20 seconds. Next, the material is subjected to a washing treatment step through a pair of guide rollers 64. In the washing treatment step, a silver halide emulsion layer of the lithographic printing plate is removed by a scrubbing roller 66 while feeding a washing solution in a shower state from a blast pipe 65 of the washing solution. After removing the washing solution on the surface of the plate with a pair of the squeeze rollers 67, the lithographic printing plate is transferred to the finishing treatment step via a pair of guide rollers 68. In the finishing treatment step, a finishing solution is fed to the surface of the plate in a shower state from a blast pipe 69 of the finishing solution. After squeezing the finishing solution on the surface of the plate by a pair of squeeze rollers 70, the lithographic printing plate is dried in a drying step and carried out via guide rollers 72. Here, the washing treatment step may be carried out by jet blasting the washing solution in place of the scrubbing roller.

Figure 13:
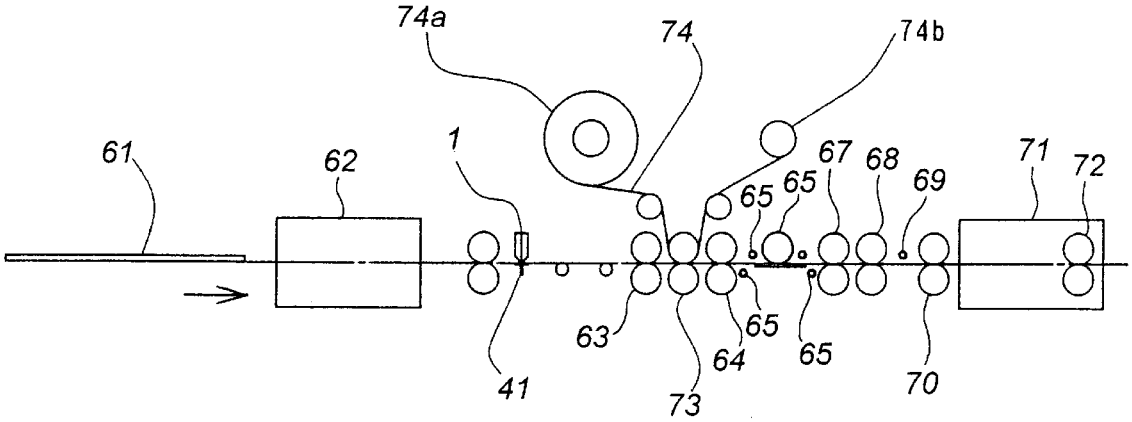
FIG. 13 is a schematic sectional view showing another embodiment of the processing apparatus of an aluminum lithographic printing plate.

Also, in the washing treatment step, in place of wash off the silver halide emulsion layer, a method of peeling off the silver halide emulsion layer by using a peeling sheet may be employed. In FIG. 13, a schematic sectional view of a processing apparatus of an aluminum lithographic printing plate using the peeling sheet is shown. The developing treatment step is the same as in FIG. 12. After squeezing the developing solution on the plate by a pair of the squeeze rollers 63, a peeling sheet 74 and the lithographic printing plate 61 are adhered by a pair of nip rollers 73 to transfer the silver halide emulsion layer of the lithographic printing plate to the peeling sheet and the sheet is peeled off.

For carrying out continuous processing in the processing apparatus, it is preferred to use a continuous roll state peeling sheet as shown in FIG. 13. The peeling sheet in a continuous roll state is employed to be a roll to roll state. That is, the peeling sheet 74 in a continuous roll state is fed from an original roll 74*a* and adhered to the lithographic printing plate by a pair of the nip rollers 73, and after peeling the silver halide emulsion layer, is wound in a roll state (74*b*).

According to the above, after peeling the silver halide emulsion layer of the lithographic printing plate, in the same manner as in FIG. 12, it is carried out via the washing treatment step, the finishing treatment step and the drying step. Here, the washing treatment step is not necessarily required but is preferably provided to completely wash off a slightly remained gelatin, etc. on the surface of the plate.

As the above-mentioned peeling sheet, a sheet comprising a support such as paper, a plastic film, etc., and a void layer provided thereon and prepared by dispersing fine particles such as silicon dioxide or alumina sol with a binder such as gelatin, polyvinyl alcohol, etc., is preferably used.

In the processing apparatus of the present invention, when a temperature of the processing liquid or an environmental temperature at the time of processing affects to the processing properties of the photosensitive material, optional measure can be taken in the present invention. That is, various measures can be taken, for example, a temperature of the processing liquid is maintained by controlling the temperature of a tank or piping of the processing liquid, temperatures of the photosensitive material or conveying rollers are controlled and temperatures of the whole environments of the processing apparatus are controlled.

In the following, Examples in which a photosensitive material is actually processed by using the processing apparatus of the present invention will be explained.

EXAMPLE 1

As a photosensitive material, the above-mentioned aluminum lithographic printing plate (A1 size: 1030 mm×800 mm, with a thickness of 0.3 mm) which had been subjected to image output by an output machine using a laser as a light source was used. Compositions of a developing solution, washing solution and finishing solution for processing the lithographic printing plate are shown below.

| | |
|---|---|
| <Developing solution> | |
| Sodium hydroxide | 25 g |
| Copolymer of polystyrenesulfonic acid and maleic anhydride (Average molecular weight Mw: 500,000) | 10 g |
| Ethylenediaminetetraacetic acid sodium salt | 2 g |
| Anhydrous sodium sulfite | 100 g |
| Monomethylethanolamine | 50 g |
| 2-Mercapto-5-n-heptyl-oxadiazole | 0.5 g |
| Sodium thiosulfate (pentahydrate) | 8 g |
| Hydroquinone | 15 g |
| 1-Phenyl-3-pyrazolidinone | 3 g |
| Make up to 1,000 ml with addition of deionized water. A pH (25° C.) = 13.1, and a viscosity is 4.7 cp. | |
| <Washing solution> | |
| 2-Mercapto-5-n-heptyl-oxadiazole | 0.5 g |
| Monoethanolamine | 13 g |
| Sodium bisulfite | 10 g |
| Potassium primary phosphate | 40 g |
| Make up to 1,000 ml with addition of deionized water. A pH = 6.0. | |
| <Finishing solution> | |
| Phosphoric acid | 0.5 g |
| Monoethanolamine | 5.0 g |
| 2-Mercapto-5-n-heptyl-oxadiazole | 0.5 g |
| Polyglycerose (hexamer) | 50 g |
| Make up to 1,000 ml with addition of deionized water. A pH = 7.2. | |

Processing was carried out by using the processing apparatus shown in FIG. 12 or FIG. 13. The developing time was set to be 12 seconds. A coating amount of the developing solution was set to 80 ml per 1 $m^2$ of the lithographic printing plate. The slot applicator used is that having a sectional surface area S of the manifold of 25 $mm^2$, a gap of the slot of 0.3 mm, a length B of the slot of 12.5 mm and a length of the lip land of 1 mm.

As a result of the test, the processing solution had been uniformly coated from the top end portion of the photosensitive material and uniform develop treatment had been carried out.

With respect to the lithographic printing plate thus prepared, printing was carried out by using a printer Heidelberg TOK (trade name, an offset printing press manufactured by Heidelberg Co.), ink (New Champion Black H, trade name, produced by Dainippon Ink Co., Japan) and commercially available dampening solution for a PS plate. As a result, it was a lithographic printing plate excellent in ink-receptive properties and having a high printing endurance of 100,000 sheets or more.

EXAMPLE 2

Developing treatment and washing treatment were carried out in the same manner as in Example 1, and then, the finishing solution was coated by using the following slot applicator. The slot applicator used was a slot applicator having a length A of the lip land of 1 mm, a sectional surface area S of the manifold of 25 $mm^2$, a gap distance C of the slot of 0.3 mm, and a length B of the slot of 20 mm.

The coating amount of the finishing solution was varied from 20 ml per 1 $m^2$ of the lithographic printing plate to 50 ml/$m^2$ with the step of each 10 ml. A viscosity of the finishing solution was 1.7 cPs. A processing rate (a conveying rate) of the lithographic printing plate from the developing solution-coating step to the finishing solution-coating step was varied from 1 cm/sec to 2 cm/sec with the step of each 0.5 cm/sec.

In all of the above-mentioned conditions, uniform coating could be carried out. Also, as a result of controlling the timing of pump driving/stopping and valve opening/closing optionally, substantially no waste solution was generated. Moreover, by making an effective coating width of the slot applicator (in other words, an effective width of the slit portion) slightly wider than the width of the lithographic printing plate, the processing liquid can be well coated also at the side edge portion of the lithographic printing plate without falling from the side edge portion of the same. Incidentally, when coating experiments of the above-mentioned finishing solution were carried out by using an apparatus disclosed in Japanese Provisional Patent Publication No. 27677/1994, unevenness in the coating amount at the side edge portion of the lithographic printing plate or liquid crack at the coating surface was likely caused. Also, with regard to stability (reproducibility) for repeated use as the processing apparatus, no result which can be applied for practical use could be obtained.

EXAMPLE 3

Tests were carried out in the same manner as in Example 1 except for changing the slot applicator was changed to the simple and easy slot applicator shown in FIG. 8 to FIG. 11 as mentioned above. As the plane plates 101 and 103 constituting this slot applicator, stainless steel having a thickness of 3 mm was used, as the plane plate 102, stainless steel having a thickness of 10 mm was used and as the film 104, a polyethylene terephthalate film having a thickness of 125 $\mu$m was used. Also, between the plane plates 101 and 102, a polyethylene terephthalate film having a thickness of 100 $\mu$m was also inserted to prevent liquid leakage. A sectional surface area S of the manifold was 30 $mm^2$, a length B of the slot was 25 mm, and a gap distance C of the slot was 125 $\mu$m.

The developing solution used was the same as used in Example 1 except for removing a copolymer of polystyrene sulfonic acid and maleic anhydride. A viscosity of the developing solution was 2.5 cp. The washing solution and the finishing solution used were the same as those used in Example 1.

A coating amount of the developing solution was varied from 40 ml to 100 ml per 1 $m^2$ of the lithographic printing plate with the step of each 10 ml. Based on this coating amount, a developing time and a development temperature were optionally adjusted. The respective lithographic printing plates thus made had uniform silver images over the whole plate surfaces. Also, when printing was carried out by using these lithographic printing plates in the same manner as in Example 1, then good printing results could be obtained in either of the printing plate.

What is claimed is:

1. An apparatus for processing a photosensitive material having a coating means of a processing liquid to a photosensitive material, which comprises using a slot applicator having a manifold and a slot at the inside of the applicator as a coating means, and a gap distance C of the slot is 0.5 mm or less, and the slot applicator satisfies the following equation (1):

$$B>50\times C/\mu^{0.3} \quad (1)$$

wherein B is a length of the slot in millimeter, $\mu$ is a viscosity of the processing liquid in centipoise.

2. The apparatus for processing a photosensitive material according to claim 1, wherein a sectional surface area S of said manifold is 100 $mm^2$ or less.

3. The apparatus for processing a photosensitive material according to claim 1, wherein a predetermined amount of the processing liquid is supplied to the slot applicator.

4. The apparatus for processing a photosensitive material according to claim 1, which further includes a thin piece member having the same size as the gap distance of the slot, that is inserted partially into inside of the slot of said slot applicator.

5. The apparatus for processing a photosensitive material according to claim 4, wherein a sectional surface area S of said manifold is 100 $mm^2$ or less.

6. The apparatus for processing a photosensitive material according to claim 4, wherein a predetermined amount of the processing liquid is supplied to the slot applicator.

7. The apparatus for processing a photosensitive material according to claim 4, wherein a means for transferring the photosensitive material, a means for detecting said photosensitive material, a slot applicator for coating a processing liquid to said photosensitive material and having a manifold and a lot at the inside of the applicator, and a means for supplying a predetermined amount of the processing liquid to said slot applicator, wherein a detection result at the detecting means of said photosensitive material is fed back to the supplying means of said processing liquid to control driving and stopping of said means for supplying the processing liquid.

8. An apparatus for processing a photosensitive material according to claim 1 which comprises a means for transferring the photosensitive material, a means for detecting said photosensitive material, a slot applicator for coating a processing liquid to said photosensitive material and having a manifold and a slot at the inside of the applicator, and a means for supplying a predetermined amount of the processing liquid to said slot applicator, wherein a detection result at the detecting means of said photosensitive material is fed back to the supplying means of said processing liquid to control driving and stopping of said means for supplying the processing liquid.

9. An apparatus for processing a photosensitive material having a coating means of a processing liquid to a photosensitive material, which comprises using a lot applicator having a manifold and a slot at the inside of the applicator as a coating means, and a member having a length of the same or longer than a width of coating is present at the position opposed to a top end portion of the slot of said slot applicator with a distance within 3 mm, and a portion of said member which is opposed to the top end portion of the slot is a flat surface, and said member is a member to form a processing liquid film between the top end portion of the slot and the member.

10. The apparatus for processing a photosensitive material according to claim 9, wherein a sectional surface area S of said manifold is 100 $mm^2$ mm or less.

11. The apparatus for processing a photosensitive material according to claim 9, wherein a predetermined amount of the processing liquid is supplied to the slot applicator.

12. The apparatus for processing a photosensitive material according to claim 9, wherein a means for transferring the photosensitive material, a means for detecting said photosensitive material, a slot applicator for coating a processing liquid to said photosensitive material and having a manifold and a slot at the inside of the applicator, and a means for supplying a predetermined amount of the processing liquid to said slot applicator, wherein a detection result at the detecting means of said photosensitive material is fed back to the supplying means of said processing liquid to control driving and stopping of said means for supplying the processing liquid.

13. The apparatus for processing a photosensitive material according to claim 9, wherein the member is a material to form a processing liquid film over the whole coating width with the top end portion of the slot.

14. An apparatus for processing a photosensitive material having a coating means of a processing liquid to a photosensitive material, which comprises using a slot applicator having a manifold and a slot at the inside of the applicator as a coating means, and said slot applicator is a slot applicator which has a first plane plate (101) in which a slender hole (105) for forming a manifold is cut and two sheets of a second plane plate (102) and a third plane plate (103) both of which fix said first plane plate (101) by sandwiching it from both sides, and a film (104) for forming a slot is interposed between either one of the first plane plate (101) and the second plane plate (102) or the first plane plate (101) and the third plane plate (103) to easily and simply form the slot applicator.

15. The apparatus for processing a photosensitive material according to claim 14, wherein said film (104) integrally has a plural number of flaps positioned at the inside of said slot.

16. The apparatus for processing a photosensitive material according to claim 14, wherein a sectional surface area S of said manifold is 100 $mm^2$ or less.

17. The apparatus for processing a photosensitive material according to claim 14, wherein a predetermined amount of the processing liquid is supplied to the slot applicator.

18. The apparatus for processing a photosensitive material according to claim 14, wherein a means for transferring the photosensitive material, a means for detecting said photosensitive material, a slot applicator for coating a processing liquid to said photosensitive material and having a manifold and a slot at the inside of the applicator, and a means for supplying a predetermined amount of the processing liquid to said slot applicator, wherein a detection result at the detecting means of said photosensitive material is fed back to the supplying means of said processing liquid to control driving and stopping of said means for supplying the processing liquid.

* * * * *